United States Patent [19]

Rosenburgh

[11] 4,160,593

[45] Jul. 10, 1979

[54] APPARATUS FOR DEVELOPING LATENT IMAGES

[75] Inventor: Norman J. Rosenburgh, Rochester, N.Y.

[73] Assignee: Eastman Kodak Company, Rochester, N.Y.

[21] Appl. No.: 881,970

[22] Filed: Feb. 27, 1978

Related U.S. Application Data

[63] Continuation-in-part of Ser. No. 763,443, Jan. 28, 1977, abandoned.

[51] Int. Cl.[2] ..... G03D 5/00; G03G 15/10

[52] U.S. Cl. ..... 354/317; 354/324; 355/10; 118/203; 118/647; 118/652

[58] Field of Search ..... 354/88, 297, 300, 317, 354/318, 323, 324, 326, 299; 15/1.5, 100; 118/203, 204, 256, 644, 647, 652, 659, DIG. 23; 355/10, 15

[56] References Cited

U.S. PATENT DOCUMENTS

| | | | |
|---|---|---|---|
| 2,582,182 | 1/1952 | Tuttle et al. | 354/323 |
| 2,780,974 | 2/1957 | Fairbank | 354/317 |
| 3,149,550 | 9/1964 | Lohse et al. | 354/323 |
| 3,176,653 | 4/1965 | Hansen | 118/647 |
| 3,181,449 | 5/1965 | Wright | 354/299 |
| 3,196,832 | 7/1965 | Zin | 118/660 |
| 3,364,833 | 1/1968 | Mulvany | 354/300 |
| 3,417,686 | 12/1968 | Hildebrand et al. | 354/317 |
| 3,683,852 | 8/1972 | Yamaguchi et al. | 355/10 |
| 3,748,995 | 7/1973 | Schroter et al. | 354/300 |
| 3,912,833 | 10/1975 | Becker | 118/203 |
| 3,936,854 | 2/1976 | Smith | 354/323 |
| 3,993,020 | 11/1976 | Schneider et al. | 355/10 |
| 4,019,816 | 4/1977 | Bernhard | 355/10 |
| 4,026,701 | 5/1977 | Till et al. | 355/315 |

*Primary Examiner*—L. T. Hix
*Assistant Examiner*—Alan Mathews
*Attorney, Agent, or Firm*—Warren W. Kurz

[57] ABSTRACT

Apparatus for applying liquid developer to a latent image-bearing surface and, after image development has been accomplished, for blow-drying the surface. Such apparatus comprises a housing against which the support material is clamped. The housing has a chamber that is open to the support material and which may be selectively interconnected to a source of air under pressure and to a reservoir containing development liquid. When connected with the reservoir of development liquid, a flow defining surface is positioned adjacent to the image-bearing material to form a flow passage for the liquid over the material. An electric potential may be applied to the flow defining surface to provide a development electrode. After development, drying air is introduced into the chamber to remove, squeegie and carry away any fluid remaining on the surface of the support material. Means are provided to wipe the flow defining surface clean of development liquid and to remove that surface from exposure to the drying air. After drying, a member which forms a restricted-flow air passage across the support material is drawn over a surface to wipe such member clean of any extraneous developer components.

23 Claims, 13 Drawing Figures

APPARATUS FOR DEVELOPING LATENT IMAGES

CROSS-REFERENCE TO RELATED APPLICATIONS

This is a continuation-in-part of my earlier filed application Ser. No. 763,443, filed on Jan. 28, 1977, now abandoned.

BACKGROUND OF THE INVENTION

1. Field of the Invention

This invention relates to apparatus for effecting liquid development of discrete latent electrostatic or photographic images.

2. Description of the Prior Art

It is well known to apply a liquid composition to a surface of a support material for developing latent electrostatic or photographic images thereon. A single liquid, usually referred to as a monobath, can be used to develop latent photographic images, whereas a liquid developer which comprises a liquid carrier and toner particles can be used to develop latent electrostatic images. On the other hand, developer and fixer solutions, as well as water, or various processing gases can be introduced sequentially into the apparatus to develop a photographic latent image in a well known manner.

In various types of apparatus known in the prior art, the development liquid can be confined to only the image area of the support material. The support material is clamped in position relative to a processing or developing head to form a development cell, and a single or a number of liquids are then applied sequentially to the surface bearing the latent image. Such processing or developing of a latent image can also include in its cycle of operation, the application to the image area of air for drying the previously applied liquid, or of a liquid which will displace the processing solutions because of its repellent characteristics. Representative prior art U.S. patents of the type described include U.S. Pat. No. 2,582,182 (issued Jan. 8, 1952 to C. M. Tuttle et al), U.S. Pat. No. 3,149,550 (issued Sept. 22, 1964 to Lohse et al) and U.S. Pat. No. 3,936,854 (issued Feb. 3, 1976 to D. S. Smith).

According to some prior art apparatus, the development cell includes a first member having an open-end chamber that is interconnected to a reservoir for at least one developing liquid and is provided with sealing means for retaining the developing liquid in proper relation to the image area being developed. The sealing means comprises at least one peripheral member that engages the latent image-bearing surface when the support material is arranged in the developing apparatus. A second member is movable relative to the first member for clamping the image-bearing support material therebetween via the sealing means. The first member is provided with suitable ducts so the developing liquid is directed as a flow over the support material or, more specifically, over the image area and within the confines of the sealing means. After the developing liquid has been applied for developing the latent image, air under pressure can be directed into the chamber to flow over the image area and discharge through a duct or ducts. The application of air under pressure squeegies any remaining liquid off the surface of the support material and carries it away through the ducts in a mist or in a finely atomized condition.

In development cells used in photographic and electrographic processes for developing latent images, a problem arises with respect to residual developer compositions (e.g., toner in electrographic processes) which are retained in the cell and build up after a period of time so as to reduce efficiency of the development process. An especially critical developer build-up problem occurs on the development electrode of electrographic processors where toner build-up rapidly occurs and causes electrical field problems from the electrode to the image. As a partial solution to this situation, it has been proposed to provide cross-flow of the developer and the air used to dry the developed image. Air applied to the image surface at right angles to the flow of developer more completely removes residual toner or other residual chemicals. However efficient such cross-flow apparatus, or any other apparatus designed to remove developer from the cell, is, there will still remain some developer in the cell which will build up over a period of time.

It has also been recognized that a venturi-forming member in the development cell, spaced closely to the image-bearing surface so as to define a shallow air passage across the surface face, effectively aids in the drying process. Of course, any residual developer build-up on this venturi-forming member would be critical because of its close proximity to the image-bearing surface, resulting in developer and/or air flow patterns on the developed image.

SUMMARY OF THE INVENTION

By the present invention, I have provided liquid development apparatus in which the aforedescribed build-up of residual toner is minimized. In accordance with the invention, those portions of the apparatus wherein developer build-up is especially critical to operation and/or most likely to occur are wiped clean of such build-up from time to time during normal operation of the apparatus. In addition, in apparatus having distinct developing and drying periods, those portions of the apparatus which are necessarily exposed to development liquid during the development period but not during the drying period may be removed from exposure to drying air during the drying period. This reduces the build-up of dried developer compositions on the surfaces so removed.

The invention and its objects and advantages will become more apparent by referring to the accompanying drawings and to the ensuing detailed description of the preferred embodiments which follow.

BRIEF DESCRIPTION OF THE DRAWINGS

In the detailed description of the preferred embodiments of the invention presented below, reference is made to the accompanying drawings in which.

DETAILED DESCRIPTION OF THE PREFERRED EMBODIMENTS

The present description will be directed in particular to elements forming part of, or cooperating more directly with, apparatus in accordance with the present invention. It is to be understood that elements, components and/or sub-components not specifically shown or described may take various forms well known to those skilled in the art.

The terms "process", "develop", "processing", "developing", etc., are to be considered synonomous as used throughout the specification and claims. Also, the term "latent-image-bearing", used in reference to support or material is meant to include electrostatic as well as photographic material.

Figure 1C:
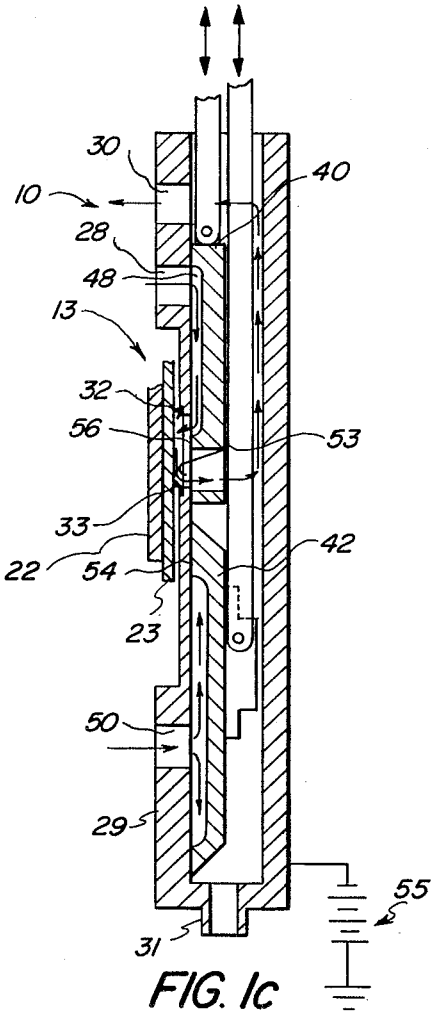
FIGS. 1*a*, 1*b* and 1*c* are vertical sectional views of a first embodiment of the present invention showing the apparatus in its "material advancing", "processing" and "drying" modes, respectively.
Figure 1B:
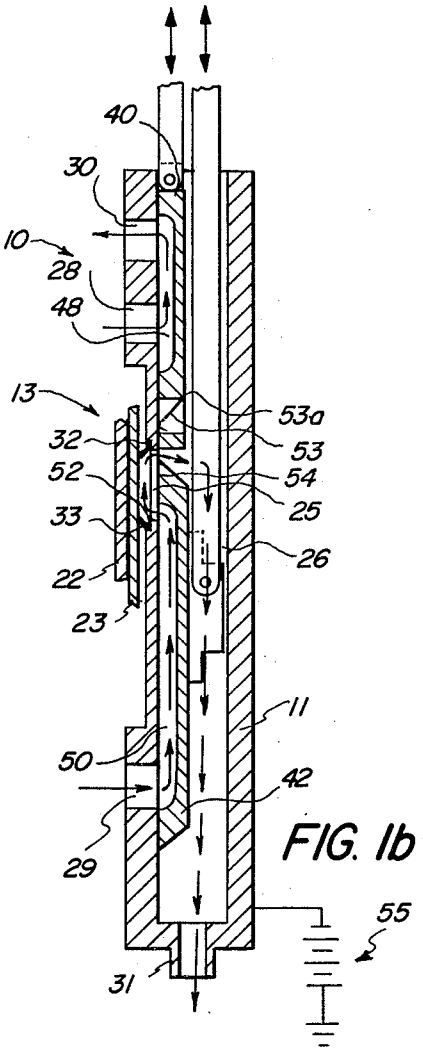
Figure 1A:
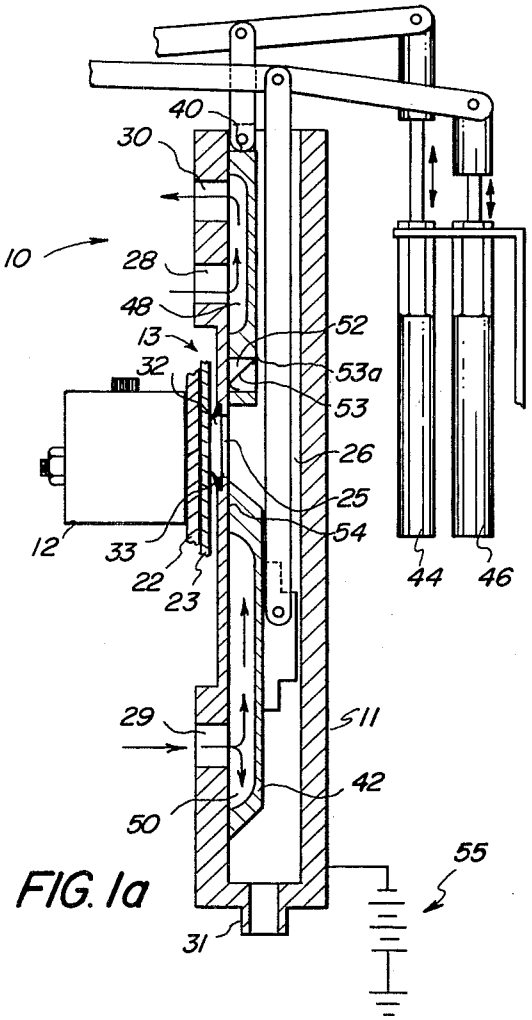

With particular reference to FIG. 1*a*, the processing apparatus, designated generally by the numeral 10, comprises a fixed housing 11 and a movable member 12, the latter being actuated into a position to clamp a sheet of latent image-bearing material 13 between housing 11 and member 12. Details of a suitable member 12 and a mechanism for moving it are disclosed in aforementioned U.S. Pat. No. 3,936,854. The disclosure of that patent is specifically incorporated herein by reference. Of course, member 12 may be fixed and housing 11 may be movable, or both may be movable.

Image-bearing support material 13 may (1) be a dielectric or (2) comprise a support layer 22 and a light-responsive layer 23. Layer 23 may be a photoconductive or an emulsion layer which can be exposed to provide a single or a plurality of latent images arranged successively in the longitudinal direction of a strip or in an X-Y format on a sheet. Such an exposed material can be processed in a well known manner with a liquid developer, such as toner for an electrostatic image or a monobath or a developer solution, a hypo solution, and finally washing with water for a photographic image.

Housing member 11 is provided with an opening 25 to a chamber 26 having entry conduits 28 and 29 and discharge conduits 30 and 31. A recess 32 surrounds opening 25 and a resilient sealing member 33 is arranged and held in the recess. Sealing member 33 can have any predetermined peripheral shape which conforms generally to that of the image area; that is, the sealing member 33 can be square, rectangular, circular or any other shape in accordance with the shape of the image area that is to be developed. Sealing member 33 comprises a mounting portion having an extension that terminates in a lip which engages the peripheral edge of the image area. The lip also serves to engage the surface of layer 23 so sealing member 33, effectively, forms with member 11, chamber 26 into which the processing liquid can be introduced in a manner to be described herein.

As pointed out hereinabove, the processing apparatus can be utilized for the processing or developing of either an electrostatic or photographic latent image. However, the apparatus that has been illustrated is used primarily for the development of an electrostatic image. Normally, the apparatus is associated with peripheral apparatus which provides the plurality of exposed areas on support material 13. These latent images are arranged in successive areas on a strip of material or in an X-Y direction on a sheet of material. In either case, the image area is separated from the adjacent area or areas, so as to provide a peripheral area in which the sealing means can engage the material without endangering or injuring any part of the latent image area per se. Consequently, the strip or sheet of material is positioned between member 12 and housing 11 and movable member 12 is then moved into a position in which the image area is surrounded by lip 33 and clamped to housing 11 in a sealed relationship.

Within chamber 26, a pair of slide valves 40 and 42 are arranged to travel vertically as shown in FIGS. 1*a*–1*c* under the control of suitable moving means, such as hydraulic cylinders 44 and 46, respectively. Slide valves 40 and 42 have respective cavities 48 and 50 to provide selective communication between conduits 28, 29, 30 and 31 and opening 25. Another opening 52 in slide valve 40 has a flexible strip of spring steel 53 secured at 53*a* to form a venturi passage to be explained hereinafter. Spring means (not shown) are provided to resiliently urge slide valves 40 and 42 toward conduits 28, 29 and 30.

OPERATION

Generally, when movable member 12 is withdrawn from housing member 11 (or vise versa) so that image-bearing member 13 may be moved therebetween, the movable elements within housing 11 are in a "material advancing" position as shown in FIG. 1*a*. In that configuration, developer which enters cavity 50 via conduit 29, is blocked by slide valve 42 from further travel. Looking at slide valve 40, it can be seen that air entering cavity 48 via conduit 28 flows out conduit 30 without entering chamber 26.

Now, after member 12 has moved to form a seal between support material 13 and sealing member 33, hydraulic cylinder 46 is activated to move slide valve 42 upwardly as viewed in FIG. 1*a* to the position shown in FIG. 1*b*, permitting the developing liquid to move from cavity 50, over the latent-image-bearing surface of layer 23 and into chamber 26. The liquid may be introduced at a controlled velocity to limit turbulence at the surface of the layer 23, rising vertically through cavity 50 and forcing ahead of it any air or other gas that might be in the cavity. As the liquid developer approaches the development zone, it moves around a flow defining surface 54 of slide valce 42, over the top of slide valve 42 and, by gravity, into discharge conduit 31. An electrical potential from a source 55 may, in the case of electrographic processing, be applied to surface 54 of slide valve 42, via conductive housing member 11, so that that surface acts in a known manner as a development electrode. After the image has been developed by the movement of the development liquid over the image-bearing surface, slide valve 42 is returned to its FIG. 1*a* position, thereby blocking further flow of developer into the development zone. Any developer liquid in chamber 26 may now drain from the chamber through conduit 31. Upon its return to its FIG. 1*a* position, development electrode surface 54 scrapes against the boundary edge of opening 25 and is thereby wiped clean of substantially all developer build-up which may have formed thereon during the development period.

Next, hydraulic cylinder 44 may be activated to move slide valve 40 from its FIG. 1*a* position to that shown in FIG. 1*c*, thereby permitting pressurized air, entering housing 11 through conduit 28, to flow over the image surface in a direction opposite to that of the flow of the processing liquid; namely, in a downward vertical direction. At the same time, any excess liquid that may have adhered to the image area or any of the surfaces within the member 11 will be exhausted via conduit 31. The air that is introduced via duct 28 is preferably warmed in order to provide a maximum drying effect. It can be seen that while drying air is flowing through chamber 26, development electrode surface 54 is in contact with an inner wall of housing 11 so that any liquid developer which might not have been wiped from the electrode surface is not exposed to the drying air. Accordingly, the amount of developer caking on the electrode is substantially reduced.

As slide valve 40 moves to its FIG. 1*c* position, venturi-forming member 53 moves into opening 25 to reduce the free space within opening 25. Venturi-forming member 53 serves to further define the flow path for drying air now passing from conduit 28, through cavity 48, around venturi 53 and back out conduit 30.

When slide valve 40 moves from its FIG. 1*a* position to its FIG. 1*c* "drying" position, there may be some residual amount of liquid developer in chamber 26. This residual developer will form a thin coating on venturi-forming member 53 and will be hardened by the drying air. After repeated cycles of the apparatus, enough developer components will likely have been deposited on the venturi-forming member to at least partially obstruct the passage of drying air.

In order to minimize such build-up, by the present invention, venturi-forming member 53 wipes against an edge 56 of housing member 11 each time slide valve 40 moves from its FIG. 1*c* position to its FIG. 1*a* position.

Other Embodiments

Figure 2:
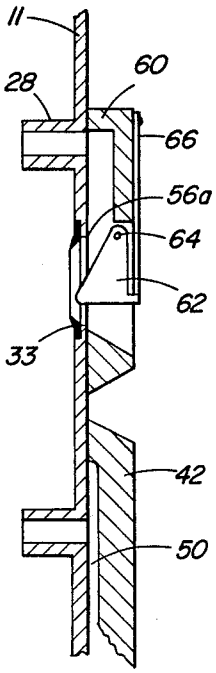
FIG. 2 is a fragmented vertical sectional view of a second embodiment of the present invention showing the apparatus in its "drying" mode.

FIG. 2 is a fragmented view of another embodiment of the present invention showing the apparatus in its "drying" mode. Apparatus not shown may take the form shown in FIG. 1*c*. In fact many parts shown are the same as in FIG. 1*c* and have been identified by the same reference numerals.

Actually the difference between the FIG. 2 embodiment and that of FIG. 1*c* is in the manner that the venturi is formed. Slide valve 60 is provided with a rigid venturi-forming member 62 pivoted at 64 and urged in a clockwise direction as shown by a leaf spring 66. Operation of the apparatus as shown in FIG. 2 is substantially the same as in FIGS. 1*a*–1*c*. Note that corner 56*a* of housing 11 will wipe along venturi-forming member 62 as slide valve 60 moves upwardly. Member 60 has been called a slide valve in this embodiment for consistency. However, it will be noted that when it is in its upper position, air entering through conduit 28 will not be valved off, but will instead flow past the venturi-forming member into chamber 26 to exhaust out the top of that chamber.

Figure 3B:
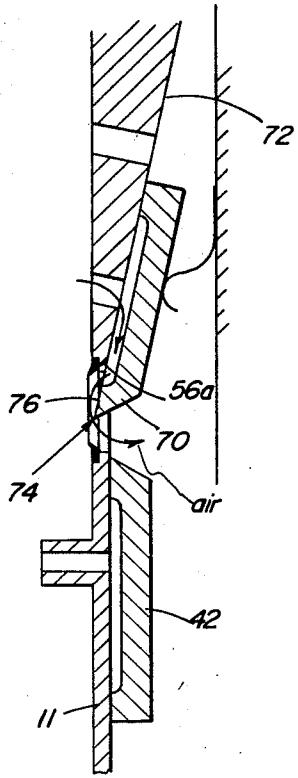
FIGS. 3*a* and 3*b* are fragmented vertical sectional views of a third embodiment of the present invention showing the apparatus in its "material advancing" & "drying modes", respectively.
Figure 3A:
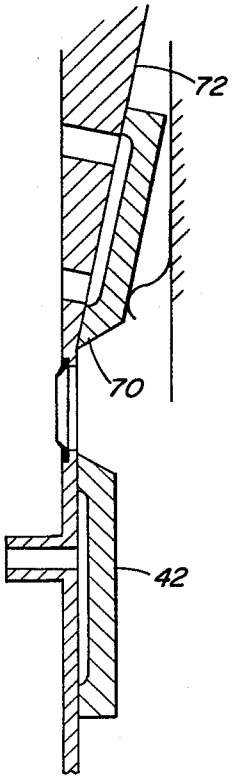

Yet another form of the present invention is shown in FIGS. 3*a* and 3*b* wherein a venturi is formed of a surface of slide valve 70 rather than with a separate member movably mounted in the slide valve. A wall 72 of housing 11 is inclined so that when slide valve 70 moves from its FIG. 3*a* position to its "drying", FIG. 3*b* position, edge 74 restricts the air flow in the manner of a venturi. As the slide valve returns to its FIG. 3*a* position, its lower surface 76 is wiped by edge 56*a* in the manner of the previous embodiments.

Figure 4:
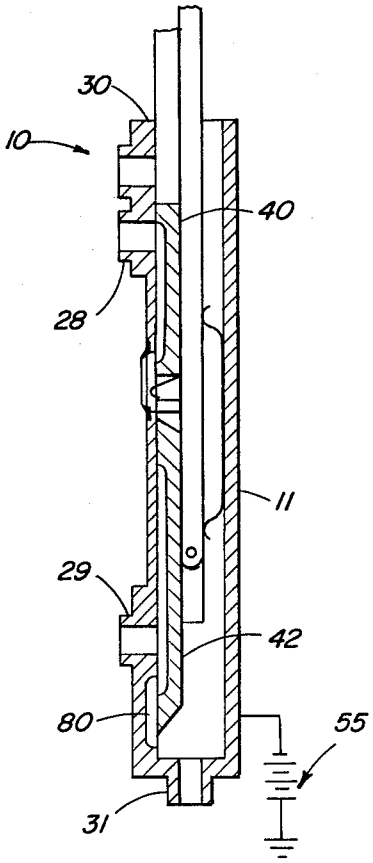
FIG. 4 is a vertical sectional view of a fourth embodiment of the present invention showing the apparatus in its "park" mode.

It is not necessary to valve off the developer inlet during drying, and in the embodiment shown in FIG. 4, I have provided a bypass cavity 80 in the wall of housing 11 to permit developer to be circulated continuously around slide valve 42, through conduit 31 and back to the reservoir when slide valve 42 is in the position shown.

Figure 5C:
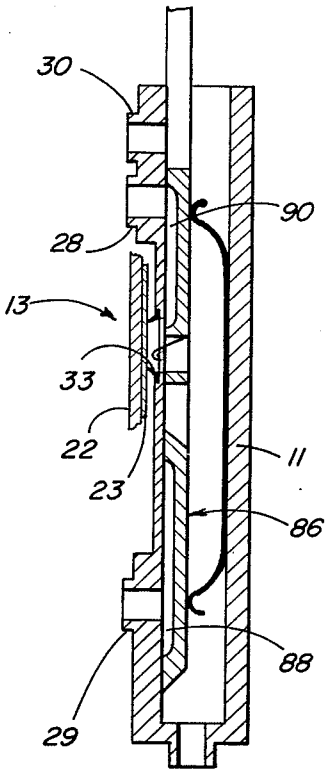
FIGS. 5*a*, 5*b* and 5*c* are vertical sectional views of a fifth embodiment of the present invention showing the apparatus in its "material advancing", "processing" and "drying" modes, respectively.
Figure 5B:
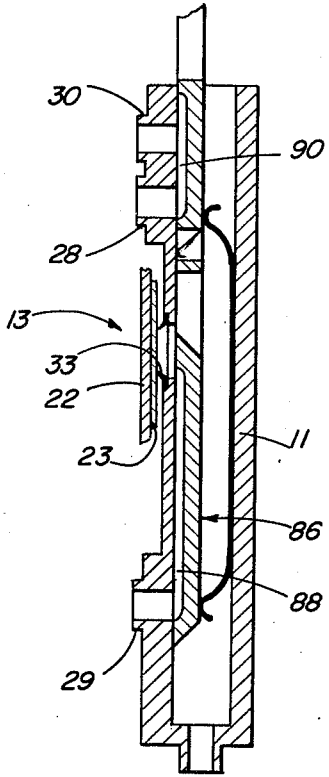
Figure 5A:
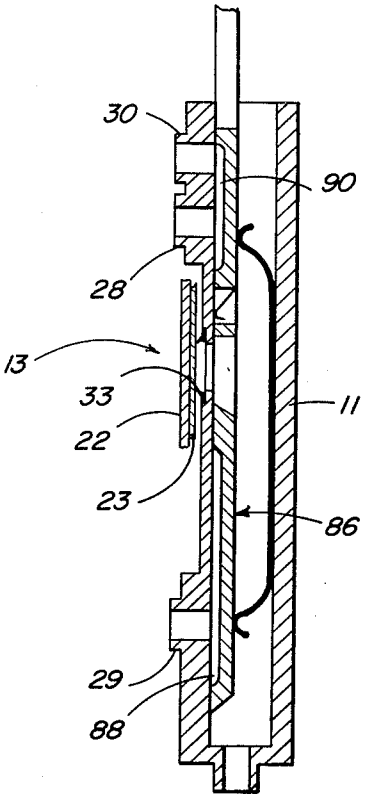

Still another embodiment of my invention is shown in FIGS. 5*a*, 5*b* and 5*c*, wherein a single slide valve 86 having three stop positions is shown. In the position shown in FIG. 5*a* development liquid at conduit 29 enters chamber 88 and is blocked from further movement. Drying air entering conduit 28 passes through chamber 90 and is exhausted through conduit 30. For development, slide valve 86 moves to the position shown in FIG. 5*b*, and for drying, the slide valve moves from the FIG. 5*a* position to that shown in FIG. 5*c*.

In some instances, it may not be desirable to return development liquid removed from the chamber directly to the supply sump. For instance, developer which was in the chamber and exposed to drying air is more likely to have clumps or other impurities therein which might cause clogging problems. Therefore, I have provided means, shown in FIGS. 6*a*, 6*b* and 6*c* for separating, from the reusable development liquid, development liquid removed from the chamber during the drying cycle. The latter may be discarded or filtered and reused.

Figure 6C:
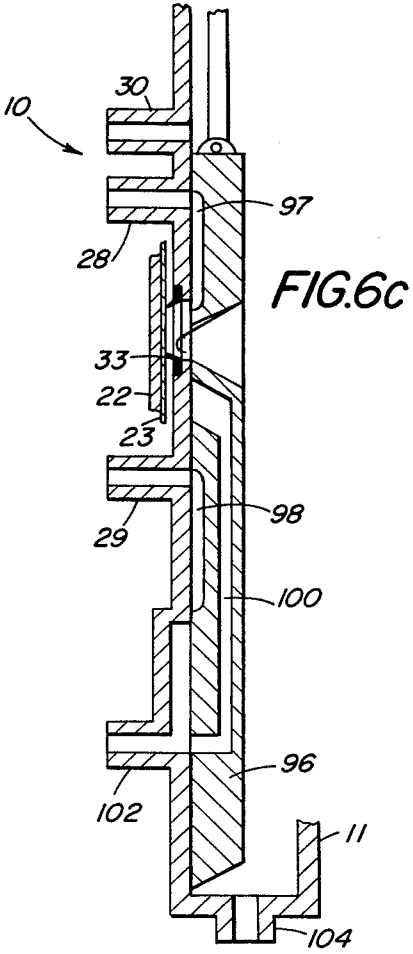
FIGS. 6*a*, 6*b* and 6*c* are vertical sectional views of a sixth embodiment of the present invention showing the apparatus in its "material advancing", "processing" and "drying" modes, respectively.
Figure 6B:
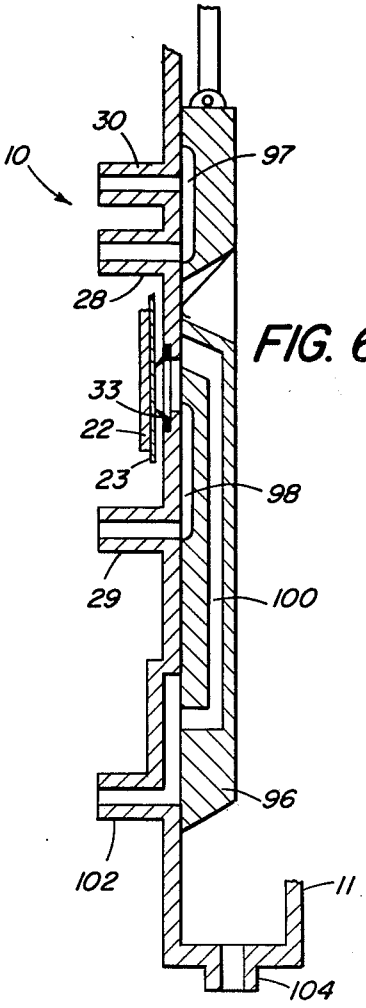
Figure 6A:
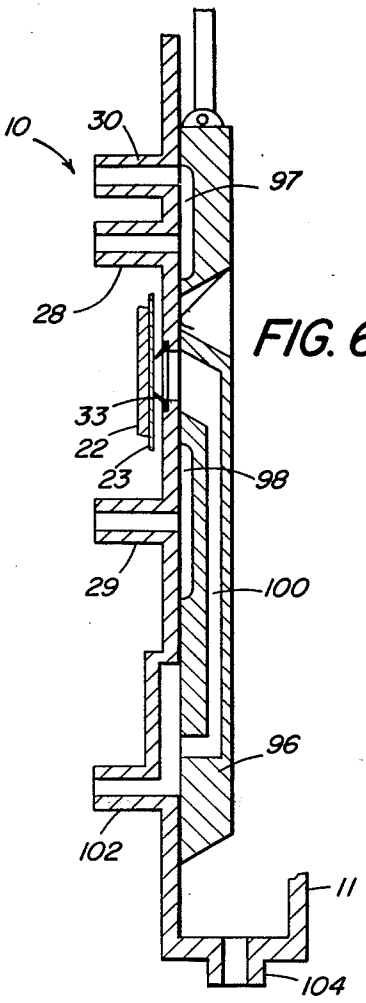

As in the FIGS. 5*a*–5*c* embodiment, the FIGS. 6*a*–6*c* embodiment includes but a single slide valve 96. In brief, when the slide valve is in its FIG. 6*a* position, drying air entering through conduit 28 passes through chamber 97 and exits through conduit 30, while development liquid cannot pass beyond chamber 98. In its "developing" mode, slide valve 96 has moved upwardly so that liquid entering through conduit 29, passes through chamber 98, over the image-bearing surface, through a passage 100 and back to the sump through another conduit 102.

When slide valve 96 moves downwardly to its FIG. 6*c*, "drying" mode, conduit 29 is again blocked and chamber 97 communicates drying air inlet conduit 28 with the image-bearing surface. Now, as mentioned above, it is desirable that any development liquid remaining in the housing member be removed to a separate receptacle for either discarding or further processing before being returned to the sump. A conduit 104 receives such liquid.

The invention has been described in detail with particular reference to preferred embodiments thereof, but it will be understood that variations and modifications can be effected within the spirit and scope of the invention.

What is claimed is:

1. Apparatus for developing a latent image on an image-bearing support, said apparatus comprising:

(a) a housing which defines a chamber, said housing having means defining an opening therein against which the image-bearing support can be positioned for communication with the chamber;

(b) first conduit means connectable to a source of development liquid under pressure;

(c) second conduit means connectable to a source of drying gas under pressure;

(d) valve means having a first operational state placing said chamber in fluid communication with said first conduit and a second operational state placing said chamber in fluid communication with said second conduit;

(e) a member having a surface which is movable along a path between (1) a developing position proximate said opening to form, with a positioned image-bearing support, a flow passage for development liquid and (2) a retracted position out of fluid communication with said chamber; and (f) control means for coordinating the operation of said valve means with the movement of said surface so that said surface is in its developing position when said valve means is in its first operational state, and so that said surface is in its retracted position when said valve means is in its second operational state.

2. Apparatus as defined in claim 1 further comprising wiping means positioned adjacent to the path of movement of said surface such that development liquid is wiped from said surface as it moves from its developing position to its retracted position.

3. Apparatus as defined in claim 1 further comprising means for placing an electrical potential on said surface, whereby said surface will function as a developing electrode when in its developing position.

4. Apparatus as defined in claim 1 wherein said valve means comprises first fluid control means for selectively disposing said chamber and said first conduit in fluid communication, and second fluid control means for selectively disposing said chamber and said second conduit in fluid communication.

5. Apparatus as defined in claim 4 wherein said first and second fluid control means are movable as a unit.

6. Apparatus as defined in claim 4 wherein said surface is coupled to said first fluid control means.

7. Apparatus for processing a latent image on an image-bearing support, said apparatus comprising:

(a) a housing which defines a chamber and having means defining an opening against which the image-bearing support can be positioned for communication with the chamber;

(b) conduit means connectable to a source of processing fluid under pressure;

(c) valve means movable between first and second positions for respectively connecting and disconnecting said chamber and said conduit means;

(d) means for moving said valve means between its first and second positions;

(e) a member having a surface which is movable along a path between (1) a processing position proximate said opening to form, with a positioned image-bearing support, a flow passage for processing fluid, and (2) a retracted position spaced from said opening;

(f) means for moving said surface to its processing position upon movement of said valve means to said first position, and to its retracted position upon movement of said valve means to its second position; and (g) wiping means adjacent to the path of movement of said surface such that the processing fluid is wiped from said surface as it moves from its developing position to its retracted position.

8. Apparatus as defined in claim 7, further comprising means for placing an electrical potential on said surface, whereby said surface functions as a development electrode when in its processing position.

9. Apparatus for developing a latent image on an image-bearing support, said apparatus comprising:

(a) a hollow housing which defines a chamber and includes means defining an opening against which the image-bearing support can be positioned for communication with the chamber;

(b) first conduit means connectable to a source of development liquid;

(c) second conduit means connectable to a source of drying gas;

(d) valve means movable between a first position connecting said chamber and said first conduit means and a second position connecting said chamber and said second conduit means;

(e) a venturi-forming member movable between a drying position, spaced from but in close proximity to, a positioned image-bearing support so as to form a restricted passage for drying air, and a second position retracted from said opening;

(f) means for moving said valve means between said first and second positions;

(g) means responsive to a movement of said valve means to said second position for moving said venturi-forming member to its second retracted position; and (h) means for wiping development liquid from said venturi-forming member upon movement to its second position.

10. Apparatus as defined in claim 9 wherein said wiping means is fixed relative to said housing and said venturi-forming member is moved in contact with said wiping means during its retracting movement.

11. Apparatus for applying fluid to image-bearing material for treatment of said image, said apparatus comprising:

(a) means defining a treating position for the material;

(b) valve means for controlling the flow of fluid toward said treating position, said valve means being movable between a first position in which it restricts the flow of fluid towards said position and a second position in which it allows fluid to flow toward said position;

(c) means for directing said fluid onto the material at the treating position, said means including a surface which is movable between an inoperative position spaced from said treating position and an operative position proximate said treating position in which it cooperates with the material to define a restricted fluid flow path along the material; and (d) means coordinating operation of said valve means and said directing means to move the latter into its operative position when said valve means is moved to its second position, said coordinating means including means for moving said surface to its inoperative position, and means operative during that movement to cleanse said surface by a wiping action.

12. Apparatus as set forth in claim 11 further including means operative when said directing means is in its inoperative position to direct a flow of cleansing fluid to said material.

13. Apparatus as set forth in claim 11 wherein said material is electrographic and said treating fluid comprises toner, and wherein means is provided for applying an electrical potential between said directing means and said material.

14. Apparatus as set forth in claim 11 wherein said surface is integral with said valve means.

15. Apparatus as set forth in claim 14 wherein said surface cooperates with said means defining a treating position to cleanse said surface during movement thereof between said operative and inoperative positions.

16. Apparatus for applying particulate developer in a fluid to electrographic material, said apparatus comprising a flow-directing surface which is selectively movable from a position spaced from said material to an operative position in close proximity to said material to define restricted flow path for the fluid, means for wiping fluid from said surface as the latter is moved away from said operative position, and means operative when said surface is spaced from said material to direct a flow of cleansing fluid to said material, said flow-directing surface being inaccessible to said cleansing fluid when said surface is spaced from said material.

17. Apparatus as set forth in claim 16 further comprising means operative when said flow-directing surface is spaced from said material to direct a flow of cleansing fluid to said material, and a second flow-directing surface cooperating with the material to define a restricted flow path for the cleansing fluid along the material.

18. Apparatus for developing an electrostatic latent image on an image-bearing support, said apparatus comprising:

(a) means defining a development chamber having an opening against which the image-bearing support can be positioned for communication with said chamber;

(b) a first conduit for admitting development liquid into said chamber;

(c) first valve means arranged in said chamber for controlling the flow of development liquid therein, said valve means having a first operational state in which it acts to restrict the flow of development liquid to said opening, and a second operational state in which it permits development liquid in said chamber to flow to said opening and communicate with an image-bearing support positioned thereagainst;

(d) a development electrode having a flow-defining surface which is movable along a path between (i) a development position proximate said chamber opening to form, with a positioned image-bearing support, a flow passage for development liquid, and (ii) a retracted position in which said surface is contiguously arranged with respect to said chamber-defining means so as to be out of communication with said development liquid; and (e) means for coordinating the movement of said flow-defining surface with the operation of said valve means to position said surface in its developing position when said valve means is operating in its second operational state, and to position said surface in its retracted position when said valve means is operating in its first operational state.

19. Apparatus as defined in claim 18 wherein said valve means is slidably mounted within said chamber for movement between said first and second operational states.

20. Apparatus as set forth in claim 18 further comprising a second conduit for admitting drying gas into said chamber, and a second valve means arranged in said chamber for controlling the flow of drying gas therein, said second valve means having a first operational state in which said second valve means permits drying gas to flow to said opening and communicate with an image-bearing support positioned thereagainst.

21. Apparatus as defined in claim 20 wherein said second valve means is slidably mounted within said chamber for movement between its first and second operational states.

22. Apparatus as defined in claim 20 further comprising means for coordinating the operation of said first and second valve means with the movement of said flow-defining surface.

23. Apparatus as defined in claim 20 wherein said second valve means comprises a second flow-restricting surface which, when said second valve means is operating in its second operational state, is positioned in close proximity to said image-bearing support to form a venturi for said drying gas.

* * * * *